US009739149B2

(12) United States Patent
Tuckey

(10) Patent No.: US 9,739,149 B2
(45) Date of Patent: Aug. 22, 2017

(54) VANE PUMP ASSEMBLY

(71) Applicant: Charles Tuckey, Pigeon, MI (US)

(72) Inventor: Charles Tuckey, Pigeon, MI (US)

( * ) Notice: Subject to any disclaimer, the term of this patent is extended or adjusted under 35 U.S.C. 154(b) by 191 days.

(21) Appl. No.: 14/451,649

(22) Filed: Aug. 5, 2014

(65) Prior Publication Data

US 2015/0037188 A1 Feb. 5, 2015

Related U.S. Application Data

(60) Provisional application No. 61/862,285, filed on Aug. 5, 2013.

(51) Int. Cl.

| | |
|---|---|
| ***F01C 1/34*** | (2006.01) |
| ***F04C 2/34*** | (2006.01) |
| ***F01C 21/08*** | (2006.01) |
| ***F01C 1/344*** | (2006.01) |
| *F04C 2/344* | (2006.01) |

(52) U.S. Cl.

CPC ..... *F01C 1/3442* (2013.01); *F01C 21/0809* (2013.01); *F01C 21/0836* (2013.01); *F04C 2/3442* (2013.01)

(58) Field of Classification Search

CPC ..... F01C 1/3442; F01C 21/0809; F01C 21/0836; F01C 3/0863; F01C 1/3445; F04C 2/3442; F04C 23/008; F04C 18/3564

USPC ..... 418/82, 184, 212, 243, 244, 266–268

See application file for complete search history.

(56) References Cited

U.S. PATENT DOCUMENTS 2,003,615 A * 6/1935 Smith ..... F01C 21/0836 418/147
4,370,111 A * 1/1983 Shea ..... F04C 2/344 418/212
4,604,041 A 8/1986 Hertell et al.
4,806,085 A * 2/1989 Costa ..... F04C 15/06 418/184
5,707,222 A * 1/1998 Otto ..... B60T 17/02 418/255
5,758,501 A 6/1998 Jirnov et al.
6,923,628 B1 * 8/2005 Otto ..... F01C 21/08 418/125
8,256,576 B2 9/2012 Glahn et al.
(Continued)

FOREIGN PATENT DOCUMENTS

CN 101852127 A 10/2010

OTHER PUBLICATIONS

International Search Report mailed Nov. 18, 2014 (PCT/US2014/049709).

*Primary Examiner* — Mark Laurenzi
*Assistant Examiner* — Dapinder Singh
(74) *Attorney, Agent, or Firm* — Robert L. Stearns; Dickinson Wright, PLLC

(57) ABSTRACT

An improved vane pump assembly is provided. The vane pump assembly includes a housing with an open chamber that is circular in shape when viewed in cross-section and has an inner wall that surrounds the open chamber. A rotor is rotatably disposed in the open chamber of the housing. As with the open chamber, the rotor is circular in shape when viewed in cross-section and has a diameter. The rotor further has at least one through-passage which extends diametrically across the rotor. The rotor is positioned such that it has a center that is offset from a center of the circular open chamber of the housing.

20 Claims, 9 Drawing Sheets

(56) References Cited

U.S. PATENT DOCUMENTS

| | | | |
|---|---|---|---|
| 8,347,848 | B2 | 1/2013 | Sleiman et al. |
| 2008/0240962 | A1 | 10/2008 | Ono et al. |

* cited by examiner

VANE PUMP ASSEMBLY

CROSS-REFERENCE TO RELATED APPLICATION

This application claims the benefit of application Ser. No. 61/862,285, filed on Aug. 5, 2013.

BACKGROUND OF THE INVENTION

1. Field of the Invention

The present invention is related generally to rotary vane pump assemblies.

2. Related Art

In general, rotary vane pump assemblies are positive displacement pumps that include one or more vanes that are mounted to a rotor which is rotatable within a cavity, or an inner chamber, of a housing. A pressure differential is applied across the vane, which causes the rotor to rotate within the open chamber of the housing. The rotor is coupled with an output shaft which may be attached to any suitable machine including, for example, an electric generator. During operation of such vane pumps, it is important to maintain a fluid-tight seal between the vane and the housing in order to optimize efficiency and maximize power output.

One approach to maintaining the fluid-tight seal between the vane and the housing is to use springs to bias the vane against the housing. Rotary vane pumps that use this approach generally include two or more vanes, and a spring is disposed between the rotor and each vane to bias the respective vane in a radially outward direction and against this housing. The biasing forces exerted by the springs maintain the vanes in continuous contact with the housing through a full 360 degrees of rotation of the rotor within the open chamber of the housing.

Another approach to maintaining the fluid-tight seal between the vane and the housing is to provide open chamber with a non-circular shape. The rotor is centered within the non-circular shaped open chamber, and a vane extends through the rotor to engage at either end with an inner wall of the non-circularly shaped open chamber. The noncircular shape of the open chamber guides the vane through a reciprocating motion back and forth across the rotor to maintain both ends of the vane in contact with the inner wall to establish the fluid tight seals.

SUMMARY OF THE INVENTION

An improved vane pump assembly which provides for increased efficiency as compared to other known vane pumps and is less costly to manufacture than other known vane pumps is provided. Rather than relying on springs or a non-circularly shaped open chamber, the vane pump assembly relies upon centrifugal force to maintain a fluid-tight seal between the vane and the housing.

One aspect of the present invention provides for an improved vane pump assembly. The vane pump assembly includes a housing with an open chamber that is circular in shape when viewed in cross-section and has an inner wall that surrounds the open chamber. A rotor is rotatably disposed in the open chamber of the housing. As with the open chamber, the rotor is circular in shape when viewed in cross-section and has a diameter. The rotor further has at least one through-passage which extends diametrically across the rotor. The rotor is positioned such that it has a center that is offset from a center of the circular open chamber of the housing.

Another aspect of the present invention provides for a vane pump assembly which includes a housing with an open chamber that is circular in shape when viewed in cross-section and has an inner wall that surrounds the open chamber. A rotor is rotatably disposed in the open chamber of the housing. The rotor is circular in whape when viewed in cross-section and has a center that is offset from a center of the circular open chamber of the housing. The rotor also has a through-passage. A vane is slidably disposed in the through-passage of the rotor, and the vane extends from outside the rotor through and past the center of the rotor.

BRIEF DESCRIPTION OF THE DRAWINGS

These and other features and advantages of the present invention will be readily appreciated, as the same becomes better understood by reference to the following detailed description when considered in connection with the accompanying drawings wherein.

DESCRIPTION OF THE ENABLING EMBODIMENT

Figure 1:
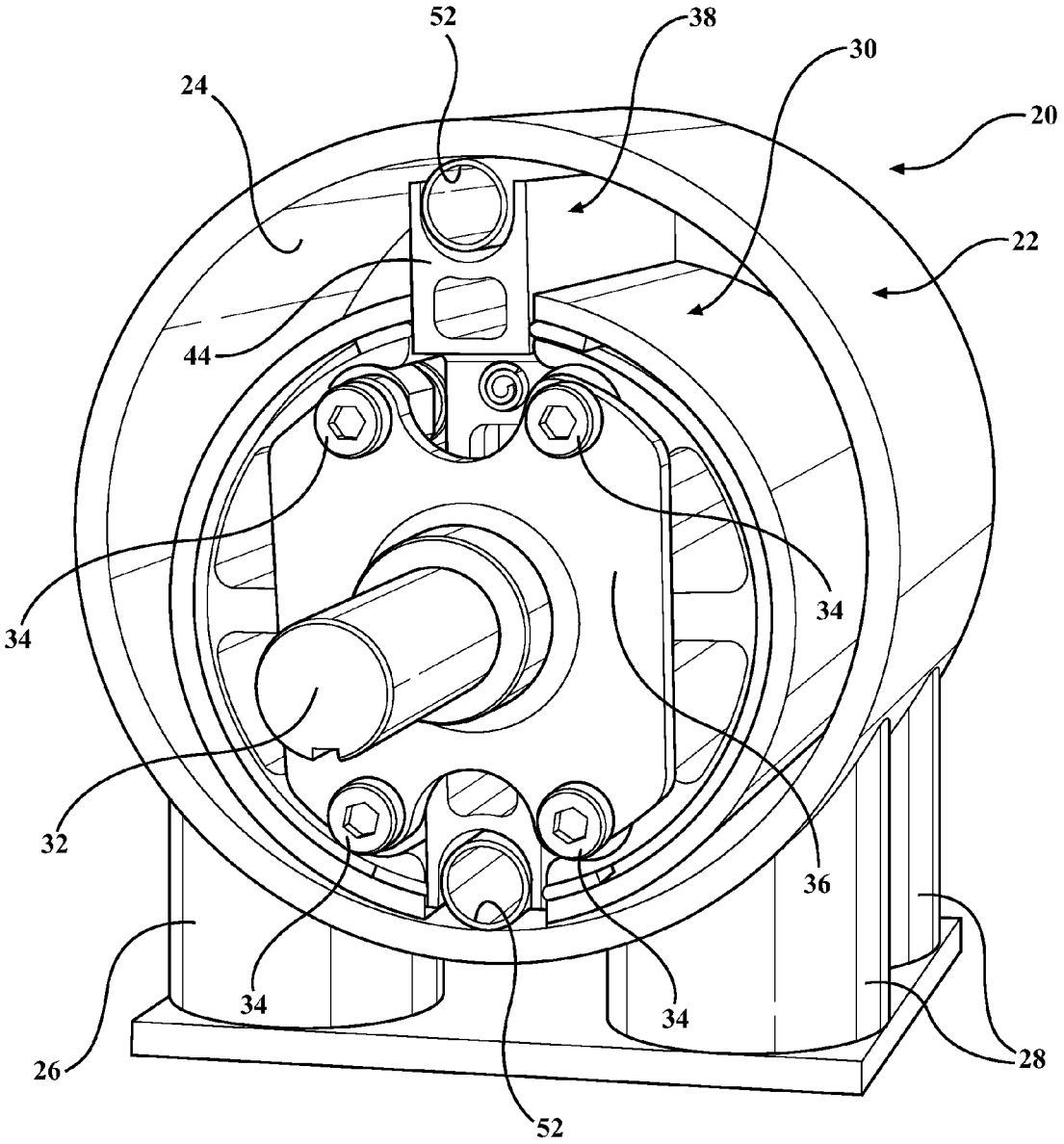
FIG. 1 is a perspective view of an exemplary embodiment of a vane pump.

Referring to the Figures, wherein like numerals indicate corresponding parts throughout the several views, an exemplary embodiment of an improved vane pump 20 assembly is generally shown in FIG. 1. As shown, the exemplary vane pump 20 includes a housing 22 with an inner wall 24 that presents an open chamber which has a circular shape when viewed in cross-section. The exemplary housing 22 also has a total of four ports 26, 28 including two fluid inlet ports 26 for conveying a fluid, such as steam, into the open chamber and two fluid outlet ports 28 for dispensing the fluid out of the open chamber. Although two of each are shown in the exemplary embodiment, it should be appreciated that the housing 22 could have any suitable number of fluid inlet ports 26 and any suitable number of fluid outlet ports 28. As shown, the fluid inlet ports 26 are spaced circumferentially from the fluid outlet ports 28.

Figure 2:
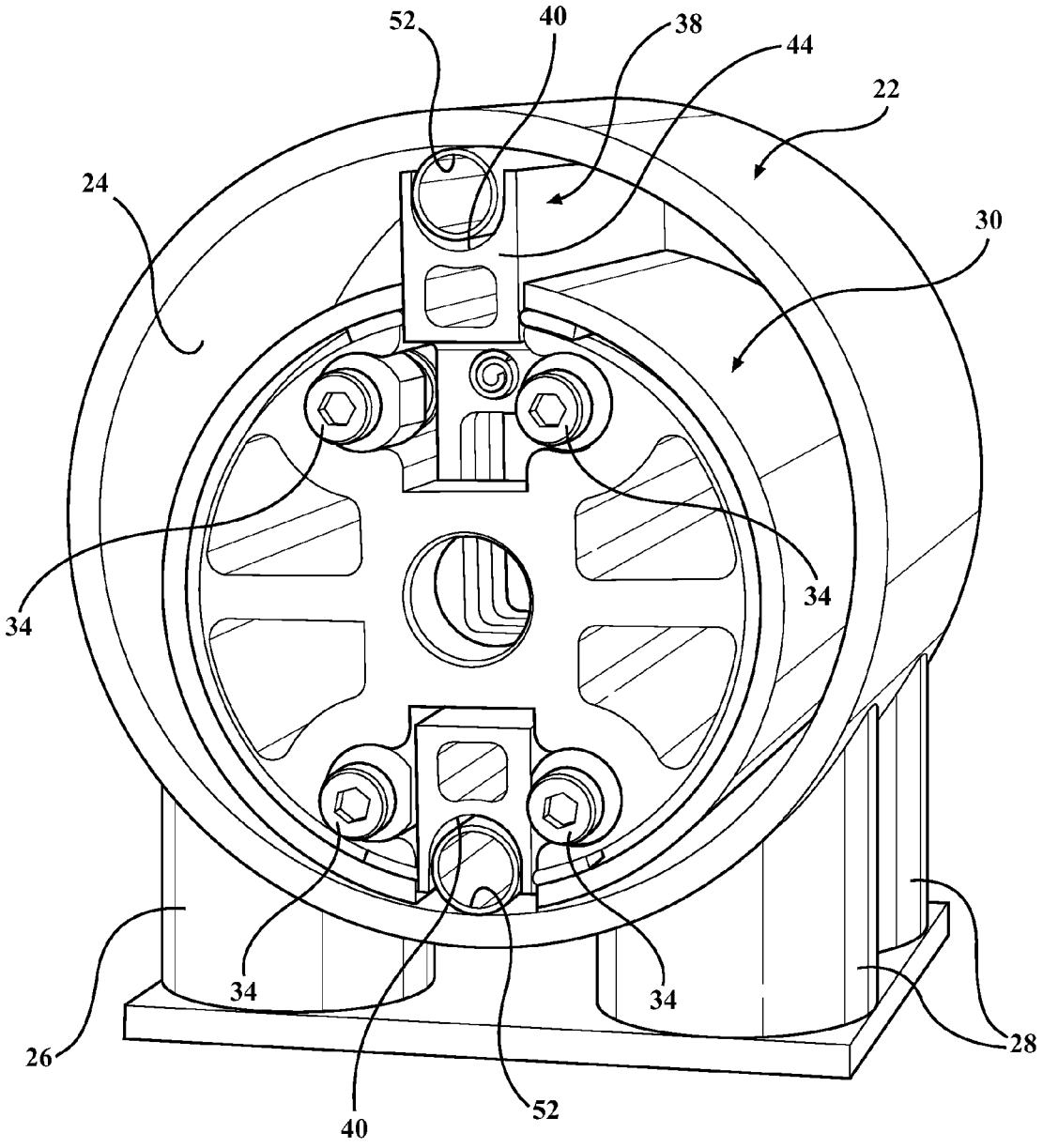
FIG. 2 is a perspective view of the vane pump of FIG. 1 with an output shaft and an end plate removed.

Referring now to FIGS. 1 and 2, the vane pump 20 further includes a rotor 30 which is generally circular in shape when viewed in cross-section and which is positioned within the open chamber of the housing 22. The rotor 30 is rotatable within the open chamber about an axis that is spaced from the center of the circular open chamber, i.e., the center of the rotor 30 is offset from the center of the circular inner chamber. More specifically, in the exemplary embodiment, the center of the rotor 30 is spaced from the center of the open chamber in a direction towards the region of the housing between the fluid inlet ports 26 and the fluid outlet ports 28. As such, the center of the circular rotor 30, which is at the axis of rotation, is spaced radially from the center of the inner chamber in the direction of a neutral area between the fluid inlet ports 26 and the fluid outlet ports 28.

The vane pump 20 further includes an output shaft 32 which extends along the axis of rotation. The output shaft 32 is fixed with the rotor 30 via a four connectors, which are elongated bolts 34 in the exemplary embodiment, and an end plate 36. The end plate 36 may be joined with the output shaft 32 through, for example, welding, such that rotation of the rotor 30 within the open chamber of the housing 22 drives rotation of the output shaft 32. As such, rotation of the rotor 30 within the open chamber of the housing 22 drives rotation of the output shaft 32, which may be coupled to any desirable power-receiving device, e.g., an electrical generator. It should be appreciated that the shaft could alternately be an input shaft rather than an output shaft if the vane pump 20 is to be used as a compressor.

Figure 3:
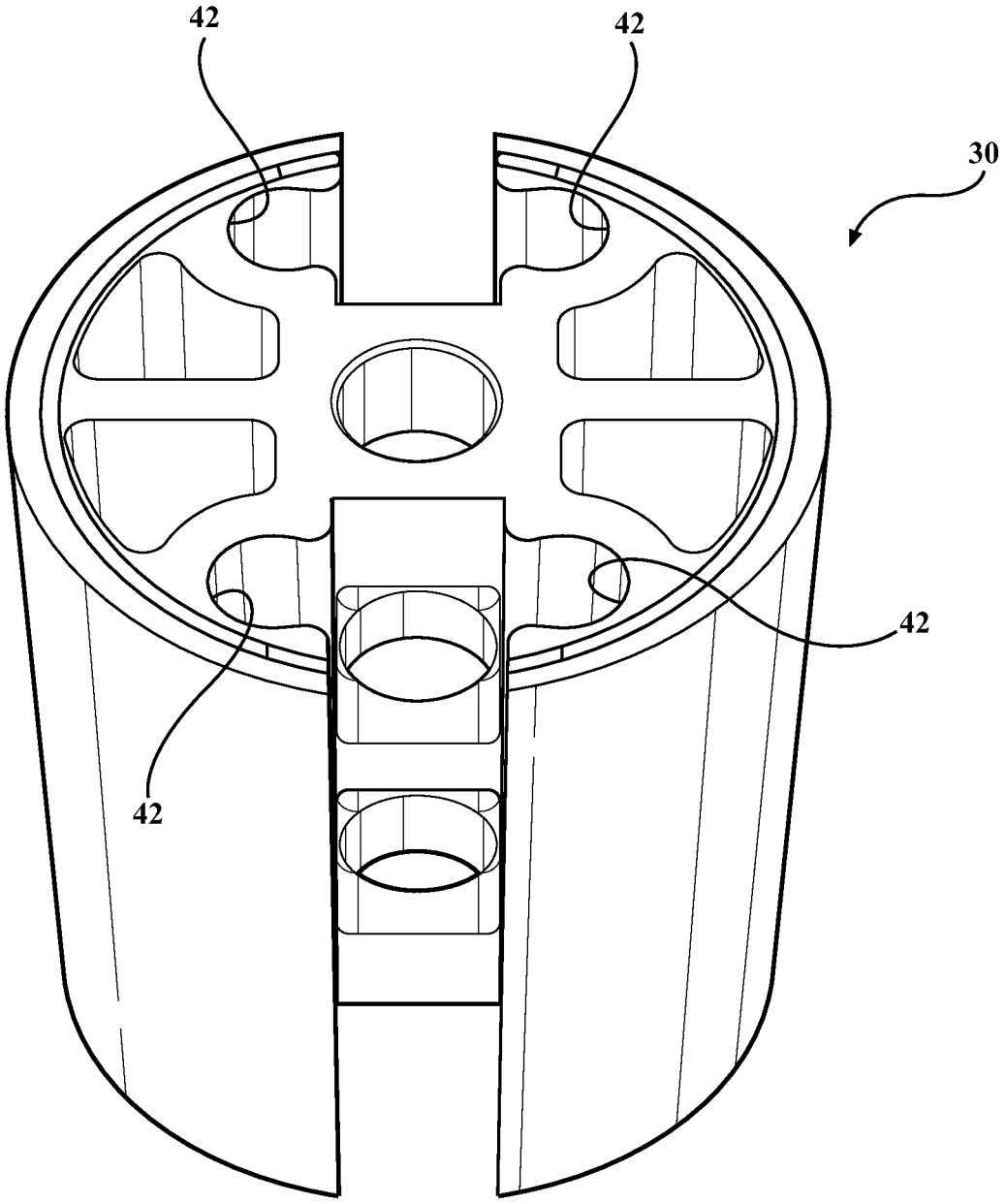
FIG. 3 is a perspective view of a rotor of the vane pump of FIG. 1.

Referring now to FIG. 3, the rotor 30 has a pair of through-passages which extend diametrically across the rotor 30 and through the axis of rotation. The rotor 30 has a shape which may be formed through an extrusion process followed by machining or drilling the through-passages therein. However, any suitable manufacturing process or processes may be employed to make the rotor 30. The rotor 30 also includes an axially extending opening which extends along the length of the rotor 30. The output shaft 32 (shown in FIG. 1) is positioned in the axially extending opening and extends past at least one axial side of the housing 22.

Referring back to FIGS. 1 and 2, a vane 38 is disposed within the through-passages of the rotor 30. The vane 38 has a length, when viewed in cross-section, which is greater than the diameter of the diameter of the rotor 30 such that the vane 38 projects radially from the rotor 30 for sealing against the inner wall 24 of the housing 22. The vane 38 is slideable or moveable within the through-passage relative to the rotor 30, which allows at least one of the ends of the vane 38 to be in sliding contact with and sealed against the inner wall 24 of the housing 22 through 360 degrees of each rotation of the rotor 30 to establish a gas tight seal capable of maintaining a pressure difference across the vane 38 within the inner chamber of the housing 22. In other words, during use, the pressure of the fluid on one side of the vane 38 is greater than the pressure of the fluid on the other side of the vane 38. This pressure difference drives rotation of the vane 38 and the rotor 30. The rotor 30 is sealed with the housing 22 at either axial end of the rotor 30 with a pair of axial seals that are disposed within generally arc shaped grooves on the opposite axial sides of the rotor 30. The axial seals are biased in the axial direction by, for example, springs.

Figure 5:
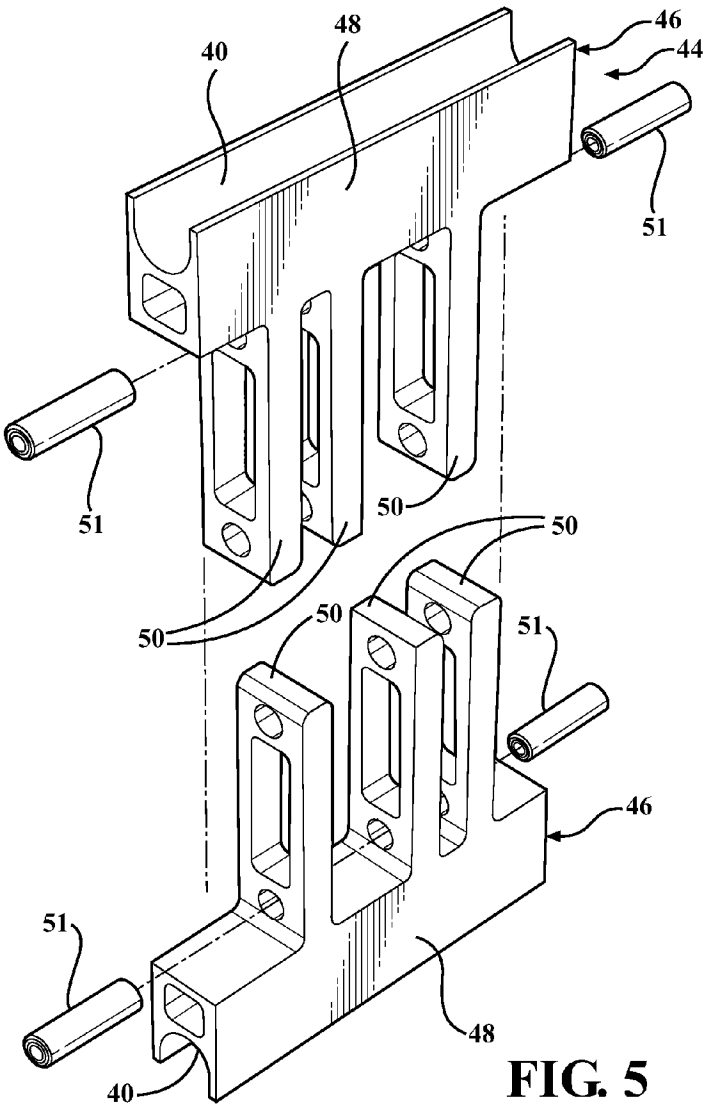
FIG. 5 is an exploded view of the vane shown in FIG. 4.
Figure 4:
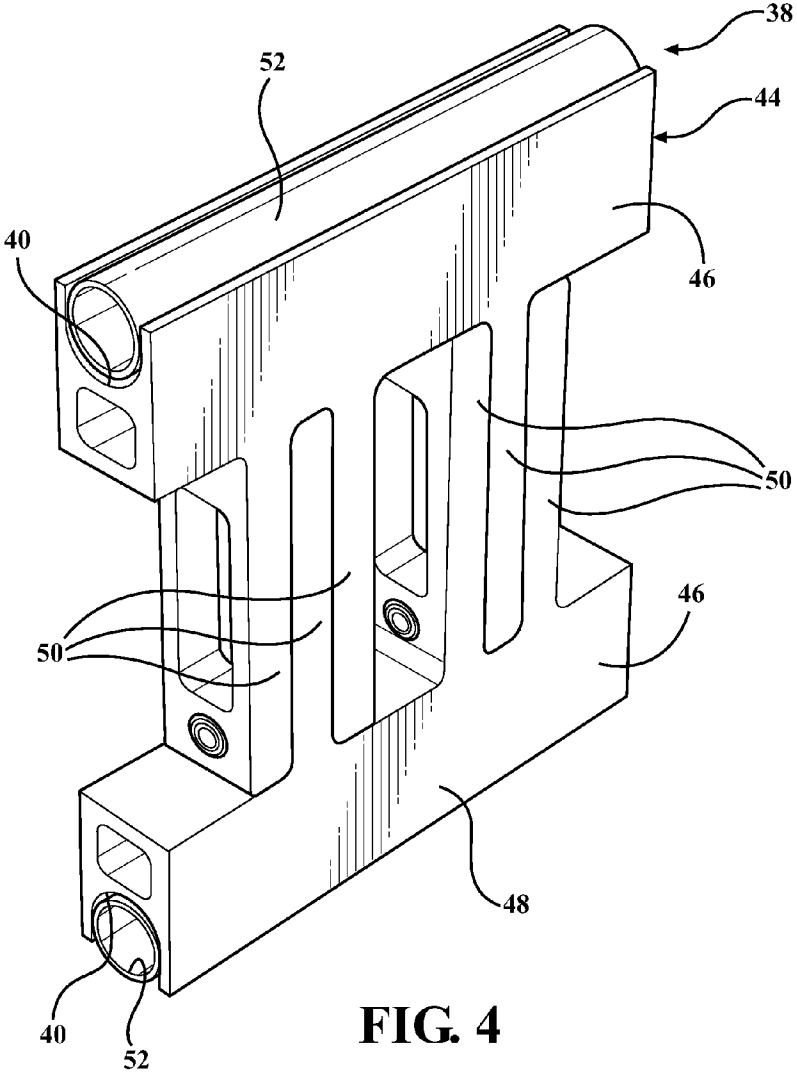
FIG. 4 is a perspective view of a vane of the vane pump of FIG. 1.

Referring now to FIGS. 4 and 5, the vane 38 of the exemplary embodiment includes a vane body 44 which is made of two pieces that are formed separately and independently of one another and are subsequently joined together to make the vane body 44. Each of the vane pieces 46 includes a base 48 and three legs 50 which extend in parallel relationship with one another transversely away from the base 48. The legs 50 of the vane pieces 46 are formed with corresponding sets of apertures such that the when the legs 50 are brought into an interleaving relationship with one another, the apertures are in alignment with one another. Pins 51 or any suitable joining means may be inserted through the aligned sets of apertures to interconnect the vane pieces 46 with one another. This two-piece vane body 44 configuration is particularly advantageous because it allows for simpler installation of the vane 38 into the through-passages of the rotor 30 (shown in FIG. 3). Specifically, one vane piece 46 may be inserted into the through-passages from one direction, and the other vane piece 46 may be inserted into the through-passages from an opposite direction. The vane pieces 46 may then be joined together within the rotor 30. However, depending on the configuration of the router, the vane 38 may take a range of shapes and configurations. The vane pieces 46 each have generally rectangular-shaped openings formed therein, and the output shaft 32 may extend through the rectangular-shaped openings.

Figure 6:
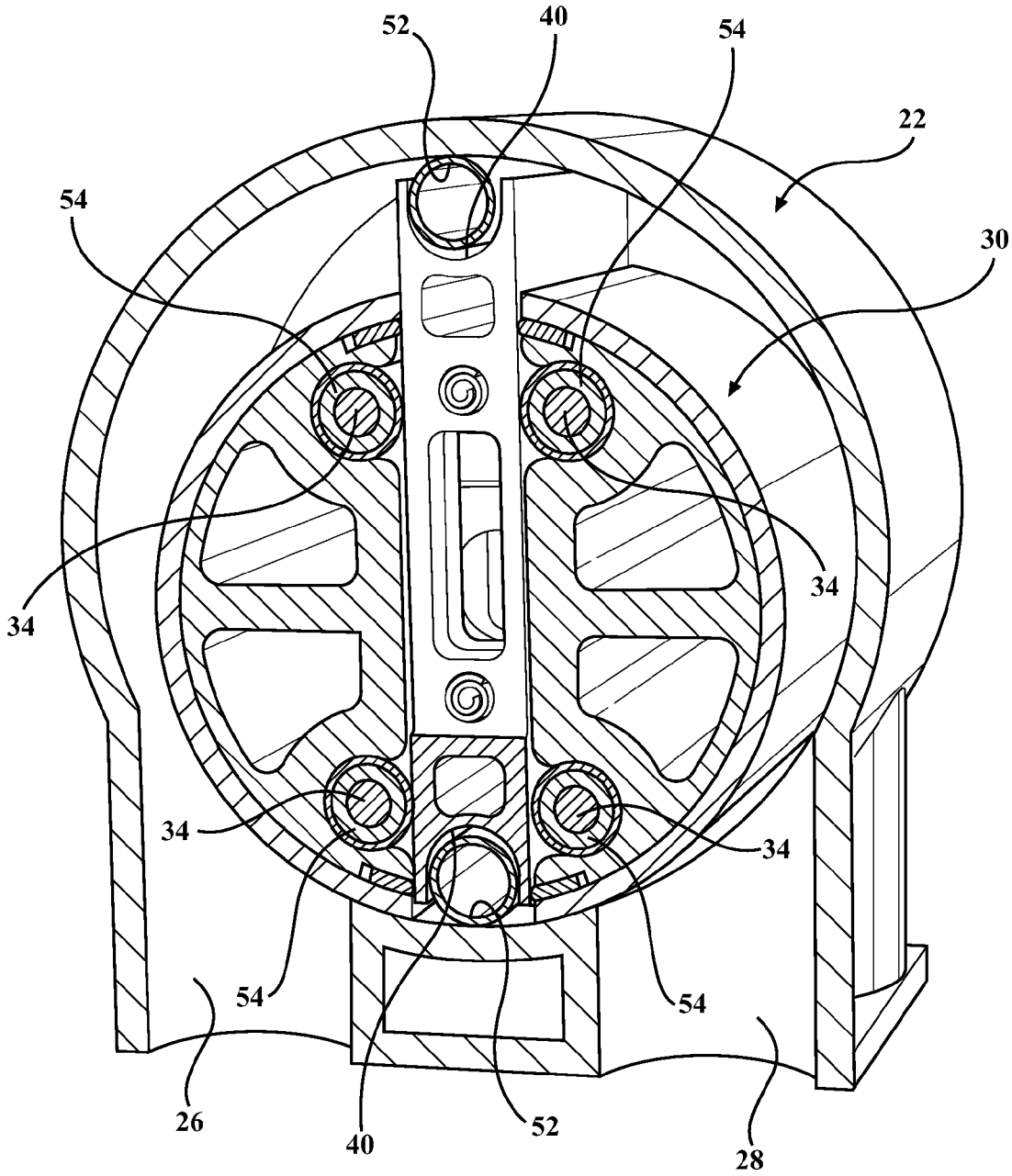
FIG. 6 is a cross-sectional view of the vane pump of FIG. 1.

Referring now to FIG. 6, opposite ends of the vane body 44 include generally U-shaped grooves 40 which face towards the inner wall 24 of the housing 22. The vane 38 further includes rollers 52 which are disposed in the U-shaped grooves 40 for rolling along the inner wall 24 to establish the fluid-tight seal between the vane 38 and the inner wall 24 of the housing 22. In the exemplary embodiment, the rollers 52 at the ends of the vane 38 are generally tubular in shape. During use, the rollers 52 are maintained in contact with the inner wall 24 of the housing 22 through centrifugal force while the single vane 38 reciprocates back and forth in the through-passage of the rotor 30 during rotation of the rotor 30. The rollers 52 allow for rolling rather than sliding con tact with the inner wall 24, which may improve the life of the vane pump 20 by reducing wear. However, it should be appreciated that the vane 38 could alternately only include one roller 52 at one end of the vane 38 while the other end of the vane body 44 slidably contacts the inner wall 24 of the housing 22.

Referring now to FIGS. 3 and 6, the rotor 30 includes a plurality of grooves 42 which are spaced from one another and which face towards the vane 38 in the through-passage. In these grooves 42, a plurality of vane articulation rollers 54 are positioned for facilitating the back and forth reciprocating movement of the vane 38 in the through-passage of the rotor 30. The vane articulation rollers 54 contact the vane 38 and rotate relative to the rotor 30 about the bolts 34 to provide a low friction interface between the vane 38 and the rotor 30.

Figure 7:
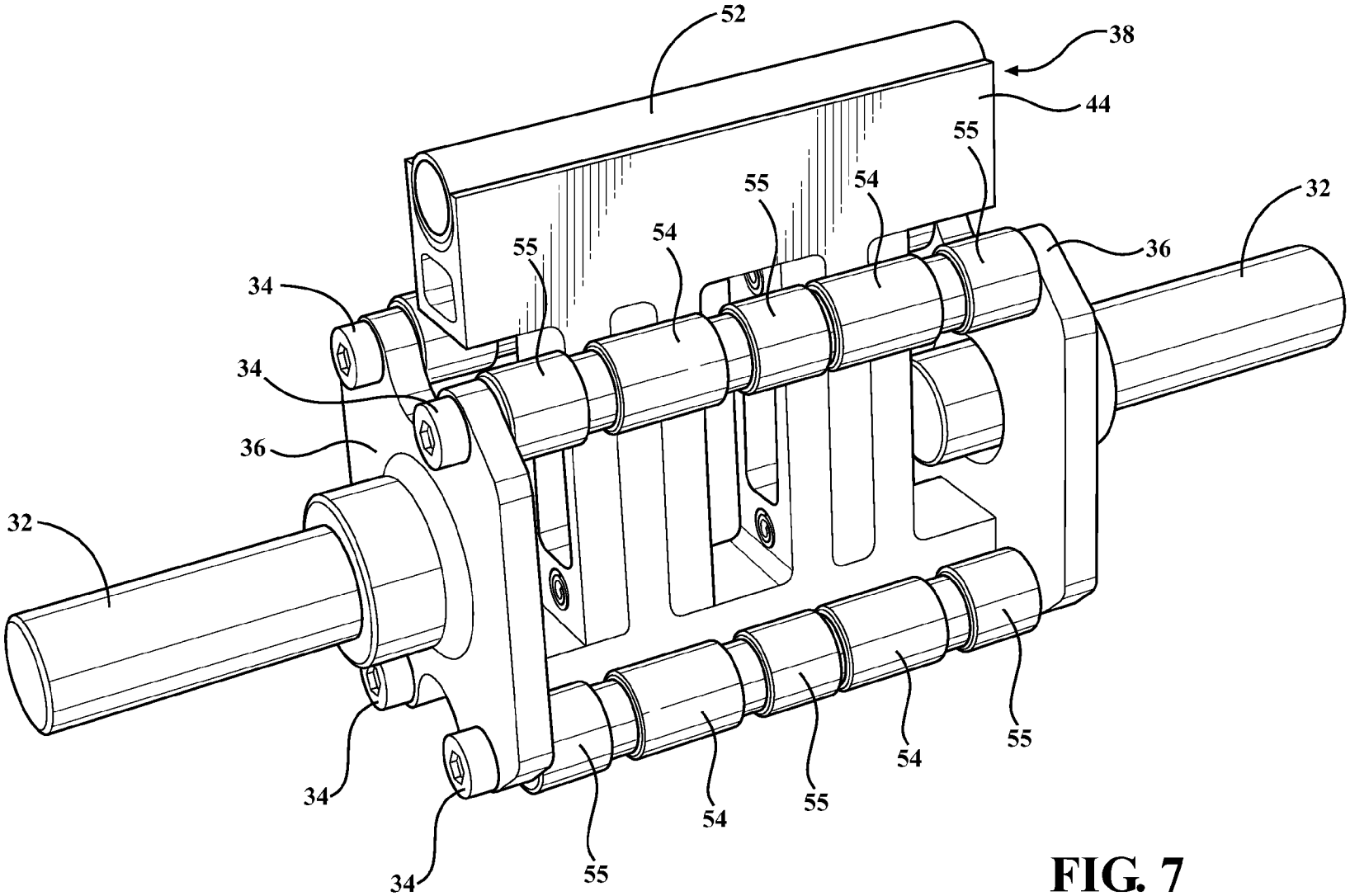
FIG. 7 is a perspective view of the vane and a plurality of vane articulation rollers and a pair of end plates and a pair of output shafts of the vane pump of FIG. 1.

The vane articulation rollers 54 are shown in greater detail in FIG. 7. In the exemplary embodiment, the vane articulation rollers 54 are disposed along the bolts 34 which extend between the end plates 36 at the opposite axial sides of the housing 22. The vane articulation rollers 54 are separated from one another by spacers 55 which maintain the vane articulation rollers 54 in predetermined longitudinal positions. During operation of the vane pump 20, the vane articulation rollers 54 roll on the respective bolts 34 while guiding and facilitating the movement of the vane 38 back and forth through the through-passages of the rotor 30 (shown in FIG. 2). During operation of the vane pump 20, a pressure differential across the vane 38 applies a force onto the vane 38, which is transferred to the rollers 52. The rollers 52 transfer the force to the bolts 34 which in turn transfer the force to the end plates 36 and ultimately to the output shaft 32 to rotate the output shaft 32.

The housing 22, rotor 30 and vane 38 of the vane pump 20 may be formed of a range of different materials such as, for example, various types of ceramics, thermoplastics or metals. These components may also be formed and assembled together through any suitable process or combination of processes.

During operation of the vane pump 20, centrifugal force from the rotation of the rotor 30 biases the vane 38 such that its ends are sealed against the inner wall 24 of the housing 22. The centrifugal force maintains the rollers 52 in rolling contact with the inner wall 24 of the housing 22 while the vane body 44 reciprocates back and forth through the through-passage of the rotor 30. Springs (not shown) may be employed between the vane body 44 and the roller 52 in order to maintain the rollers 52 in contact with the inner wall 24 of the housing 22 when the vane pump 20 is not in operation and thus there is no centrifugal force.

Figure 8:
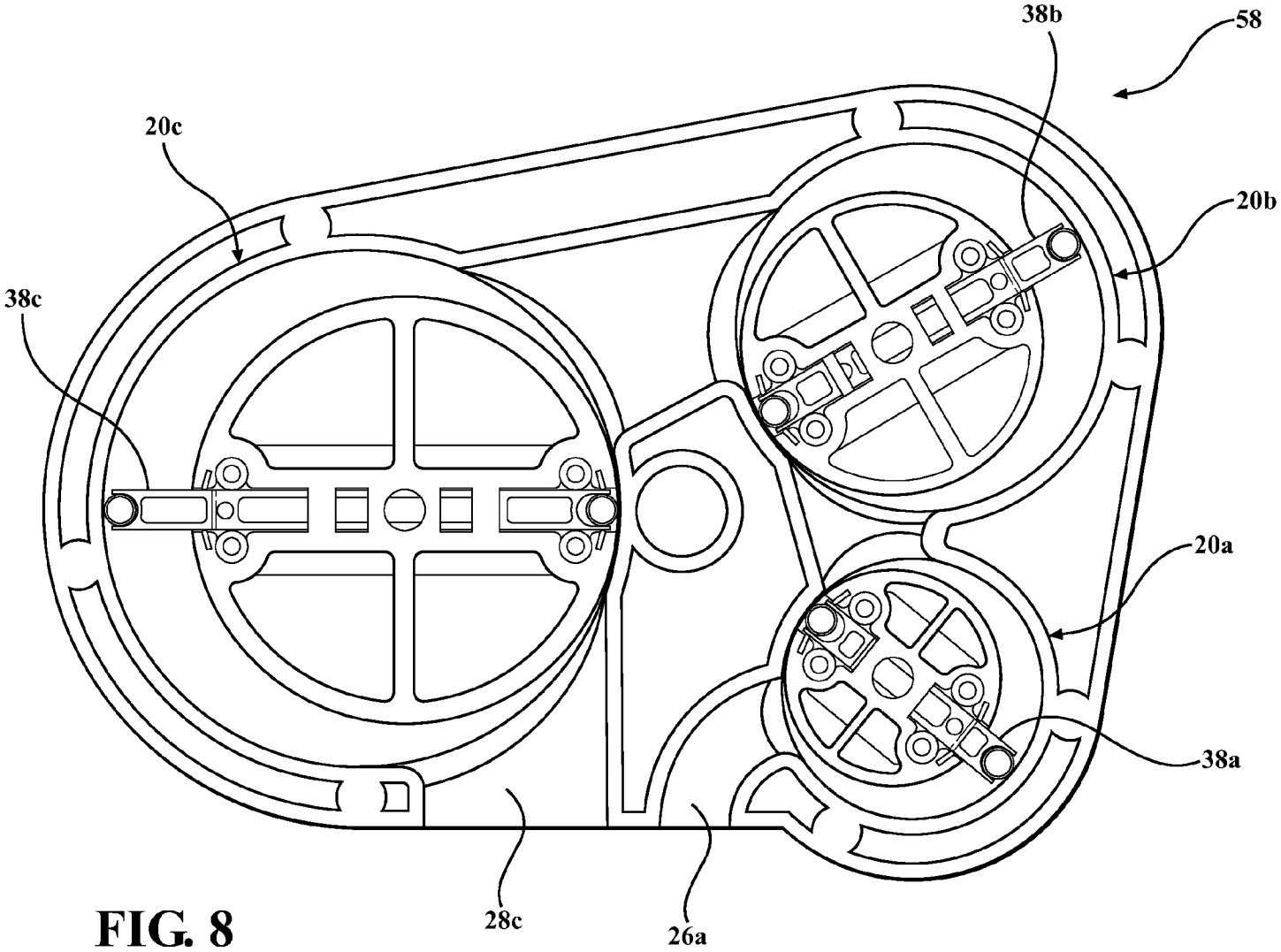
FIG. 8 is a cross-sectional view of an engine including three exemplary vane pumps.

Referring now to FIG. 8, an exemplary embodiment of an engine 58 including three of the above-described vane pumps 20 is generally shown. The vane pumps 20*a*, 20*b*, 20*c* are arranged in a generally triangular pattern. The engine 58 includes a first vane pump 20*a* which receives the fluid from outside of the engine 58, a second vane pump 20*b* which receives the fluid from the first vane pump 20*a* and a third vane pump 20*c* which receives the fluid from the second vane pump 20*b*. In other words, the first, second and third vane pumps 20*a*, 20*b*, 20*c* are in fluidly connected in series with one another. Each respective vane pump is larger than the previous vane pump to provide for improved efficiency since the pressure of the fluid decreases as it travels through each respective vane pump 20. In operation, the fluid enters the engine 58 through the fluid inlet port 26*a* of the first vane pump 20*a* and leaves the engine 58 through the fluid outlet port 28*c* of the third vane pump 20*c*. The vanes 38*a*, 38*b*, 38*c* of the three vane pumps 20*a*, 20*b*, 20*c* are oriented relative to one another such that the engine 58 operates smoothly. Specifically, the vanes 38 are oriented such that the moments created by the three vanes 38*a*, 38*b*, 38*c* balance with one another to prevent a rotating imbalance that could cause vibration during operation of the engine 58.

Figure 9:
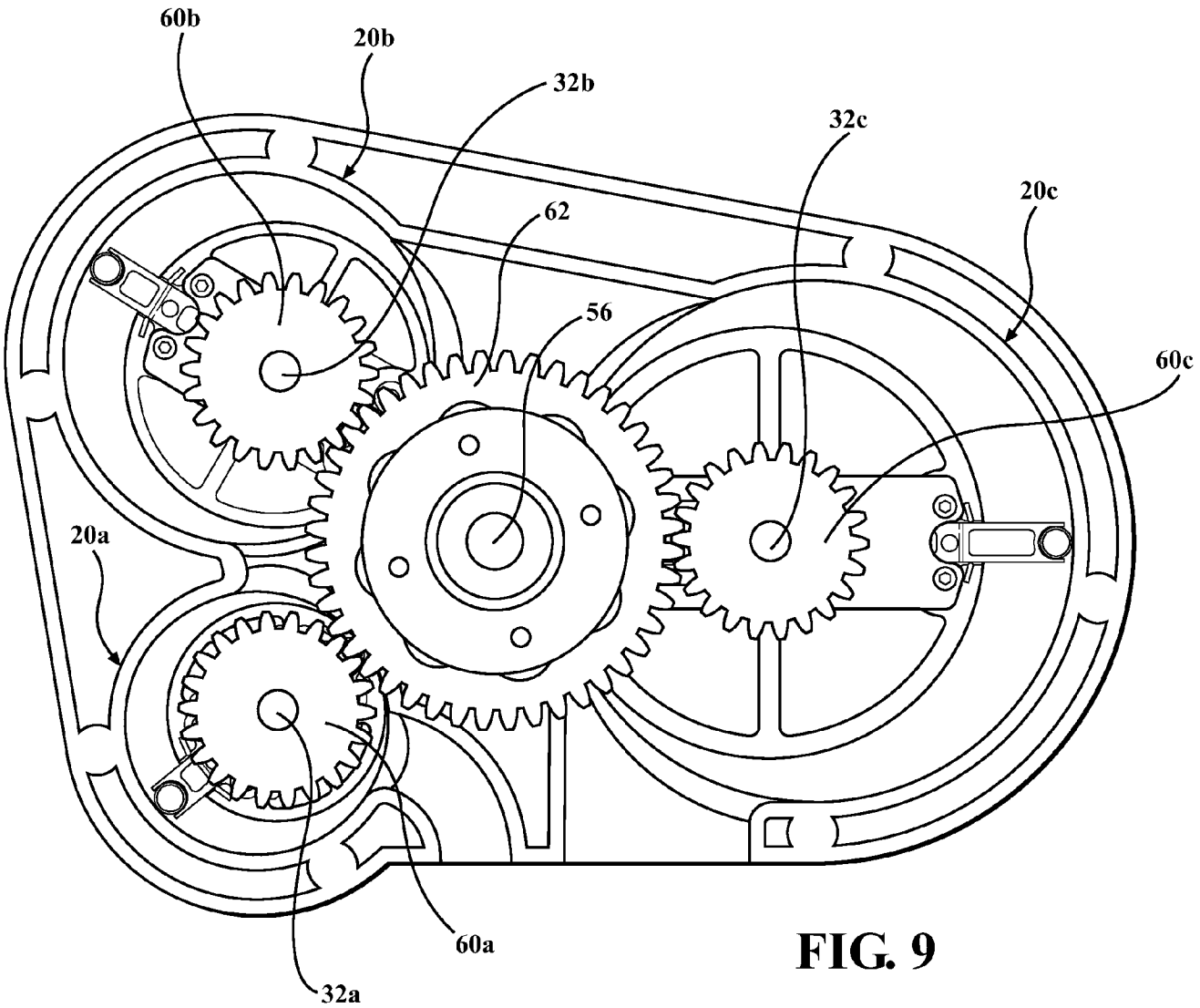
FIG. 9 is another sectional view of the engine including three exemplary vane pumps.

Referring now to FIG. 9, an output shaft 32*a*, 32*b*, 32*c* of each of the vane pumps 20*a*, 20*b*, 20*c* is connected to a gear 60*a*, 60*b*, 60*c*, and the three vane pump 20*a*, 20*b*, 20*c* gears 60*a*, 60*b*, 60*c* are mechanically connected to a central, engine output gear 62 and an engine output shaft 56. Accordingly, the three vane pumps 20*a*, 20*b*, 20*c* are mechanically connected with one another to cooperatively drive the engine output shaft 56.

Figure 10:
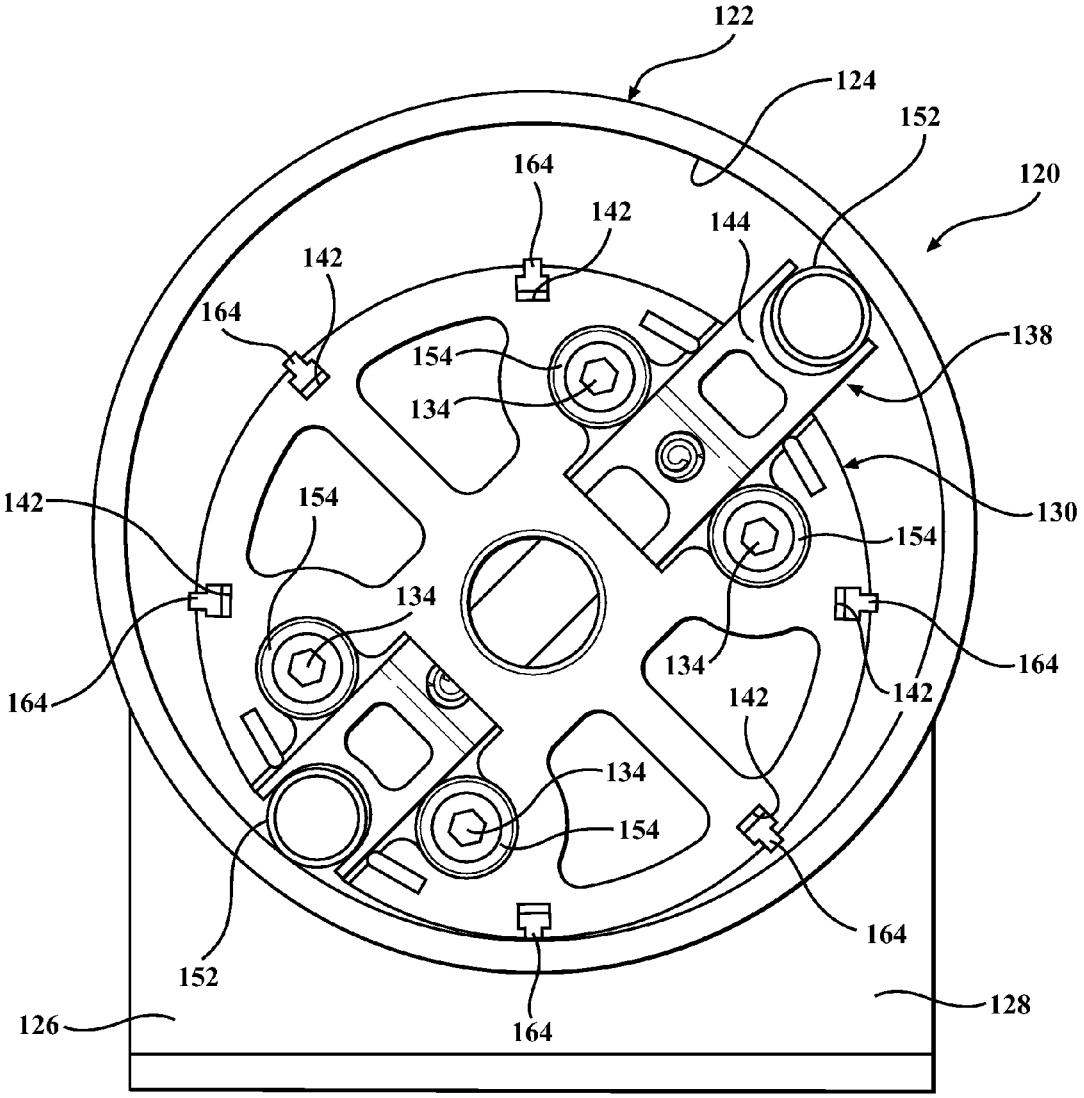
FIG. 10 is a front view of an alternate embodiment of the vane pump and with an end plate and an output shaft removed.

Referring now to FIG. 10, an alternate embodiment of the vane pump 120 is generally shown with like numerals, separated by a factor of 100, indicating corresponding parts with the first exemplary embodiment described above. This alternate embodiment is distinguished from the above-described embodiment in that it further includes a plurality of circumferentially spaced T-shaped seals 164 which are received within a plurality of T-shaped grooves 142 in the rotor 130. The T-shaped grooves 142 in the rotor 30 extend deeper than the T-shaped seals 164 are wide, thereby allowing each of the T-shaped seals 164 to move from a first position where it is substantially entirely disposed within the rotor 130 to a second position where the T-shaped seal 164 projects out of the rotor 130. During operation of the vane pump 120, centrifugal force from the rotating rotor 130 biases the T-shaped seals 164 towards the second positions. However, when each respective T-shaped seal 164 is in the area of the open chamber between the fluid inlet ports 126 and the fluid outlet ports 128, it is biased by the inner wall 124 into the first position while also establishing a fluid-tight seal between the rotor 130 and the inner wall 124 of the housing 122. This may reduce leakage of fluid directly from the fluid inlet ports 126 to the fluid outlet ports 128 in the incorrect direction through the open chamber around the rotor 130.

The vane pump 20 may be powered by any suitable source of pressurized fluid including, for example, steam. The vane pump 20 may be disposed in a Rankine style heat engine to provide the pressurized steam to drive rotation of the rotor 30 in the vane pump 20.

Obviously, many modifications and variations of the present invention are possible in light of the above teachings and may be practiced otherwise than as specifically described while within the scope of the appended claims.

What is claimed is:

1. A vane pump assembly, comprising:

a housing having an open chamber that is circular in shape when viewed in cross-section and having an inner wall that surrounds said open chamber;

a rotor rotatably disposed in said open chamber of said housing, said rotor being circular in shape when viewed in cross-section and having a diameter, said rotor having at least one through-passage which extends diametrically across said rotor, and said rotor having a center that is offset from a center of said circular open chamber of said housing;

a vane body made of two pieces that are fixedly attached with one another to prevent relative movement between said multiple pieces such that said vane body has a fixed length during operation of said vane pump assembly;

each of said pieces of said vane body including a total of three legs with one of said legs being inserted between and locked with two of said legs of said other piece; and said vane body being slidably disposed in said through-passage of said rotor and having a length that is greater than said diameter of said rotor for articulating back and forth as a single unit in said through-passage of said rotor to seal against said inner wall of said housing through centrifugal force in response to rotation of said rotor.

2. The vane pump assembly as set forth in claim 1 wherein said vane body extends between opposite ends and includes a roller disposed in a groove in at least one of said ends of said vane body.

3. The vane pump assembly as set forth in claim 2 wherein said vane body includes grooves in both of said ends and includes rollers disposed in said grooves at both of said ends.

4. The vane pump assembly as set forth in claim 1 further including a plurality of vane articulation rollers for guiding articulation of said vane body in said through-passage during operation of said vane pump.

5. The vane pump as set forth in claim 4 further including a pair of end plates disposed at opposite ends of said rotor and a plurality of fasteners extending through said rotor and between said end plates.

6. The vane pump as set forth in claim 5 wherein said plurality of vane articulation rollers are disposed on said fasteners.

7. The vane pump as set forth in claim 6 wherein said end plates are coupled with a shaft.

8. A vane pump assembly, comprising:

a housing having an open chamber that is circular in shape when viewed in cross-section and having an inner wall that surrounds said open chamber;

a rotor rotatably disposed in said open chamber of said housing, said rotor being circular in shape when viewed in cross-section and having a center that is offset from a center of said circular open chamber of said housing, and said rotor having a through-passage;

a vane body slidably disposed in said through-passage of said rotor;

said vane body being made of two pieces that are fixedly attached with one another to prevent relative movement between said multiple pieces such that said vane body has a fixed length during operation of said vane pump assembly;

each of said pieces of said vane body including a total of three legs with one of said legs being inserted between and locked with two of said legs of said other piece; and said vane body extending from outside of said rotor through and past said center of said rotor.

9. The vane pump assembly as set forth in claim 8 wherein said through passage of said rotor extends across a diameter of said rotor.

10. The vane pump assembly as set forth in claim 9 wherein said vane body extends between opposite ends and includes a roller disposed in a groove in at least one of said ends of said vane body.

11. The vane pump assembly as set forth in claim 10 wherein said vane body includes grooves in both of said ends and includes rollers disposed in said grooves at both of said ends.

12. The vane pump assembly as set forth in claim 8 further including a plurality of vane articulation rollers for guiding articulation of said vane body in said through-passage during operation of said vane pump.

13. The vane pump as set forth in claim 12 further including a pair of end plates disposed at opposite ends of said rotor and a plurality of fasteners extending through said rotor and between said end plates.

14. The vane pump as set forth in claim 13 wherein said plurality of vane articulation rollers are disposed on said fasteners.

15. The vane pump as set forth in claim 14 wherein said end plates are coupled with a shaft.

16. An engine assembly, comprising:

at least two vane pumps which are mechanically connected with one another and are fluidly connected in series with one another;

each of said vane pumps having;

a housing with an open chamber that is circular in shape when viewed in cross-section and having an inner wall that surrounds said open chamber, a rotor that is rotatably disposed in said open chamber of said housing and is circular in shape when viewed in cross section and has a diameter and has at least one through-passage which extends diametrically across said rotor and has a center that is offset from a center of said open chamber of said housing, a vane body made of two pieces that are fixedly attached with one another to prevent relative movement between said multiple pieces such that said vane body has a fixed length during operation of said engine assembly, said vane body being slidably disposed in said through-passage of said rotor and having a length that is greater than said diameter of said rotor for articulating back and forth in said through-passage as a single unit to seal against said inner wall of said housing through centrifugal force in response to rotation of said rotor, and each of said pieces of said vane body including a total of three legs with one of said legs being inserted between and locked with two of said legs of said other piece; and said vane pumps being mechanically connected with a single engine output shaft.

17. The engine assembly as set forth in claim 16 wherein said vane bodies of said vane pumps extend between opposite ends and include a roller disposed in a groove in at least one of said ends.

18. The engine assembly as set forth in claim 17 wherein each of said vane bodies includes grooves in both of said ends and includes rollers disposed in said grooves at both of said ends.

19. The engine assembly as set forth in claim 16 further wherein each of said vane pumps further includes a plurality of vane articulation rollers for guiding articulation of said vane body in said through-passage during operation of said vane pump.

20. The vane pump as set forth in claim 19 wherein each of said vane pumps further includes a pair of end plates disposed at opposite ends of said rotor and a plurality of fasteners extending through said rotor and between said end plates and wherein said plurality of vane articulation rollers are disposed on said fasteners.

* * * * *